United States Patent [19]

Ebisuno

[11] Patent Number: 5,033,748

[45] Date of Patent: Jul. 23, 1991

[54] SOLID GOLF BALL

[75] Inventor: Tadahiro Ebisuno, Nishinomiya, Japan

[73] Assignee: Sumitomo Rubber Industries, Ltd., Hyogo, Japan

[21] Appl. No.: 462,477

[22] Filed: Jan. 9, 1990

[30] Foreign Application Priority Data

Jan. 9, 1989 [JP] Japan ..... 1-4195

[51] Int. Cl.[5] ..... A63B 37/12

[52] U.S. Cl. ..... 273/218; 273/220

[58] Field of Search ..... 273/218, 220, 230, 62

[56] References Cited

U.S. PATENT DOCUMENTS 4,570,937 2/1986 Yamada ..... 273/218

4,974,852 12/1990 Hiraoka et al. .

*Primary Examiner*—George J. Marlo

*Attorney, Agent, or Firm*—Birch, Stewart, Kolasch & Birch

[57] ABSTRACT

Disclosed is a solid golf ball (including a one piece solid golf ball and another type solid golf ball) which has excellent durability and a high impact resilience, as well as good feeling when struck. The solid golf ball of the present invention is characterized in that a hardness (H) of a rubber portion of the solid golf ball, when measured by a JIS-C hardness meter, decreases with distance from the surface to the center and satifies the following equation;

When $0 \leqq l \leqq 5$ $416 - 6l \leqq 5H \leqq 440 - 6l$

When $5 < l \leqq r$ $77 \leqq H \leqq 82$ wherein l is a distance in mm from the surface and r is the radius of the golf ball.

10 Claims, 2 Drawing Sheets

SOLID GOLF BALL

FIELD OF THE INVENTION

The present invention relates to a solid golf ball which is excellent in durability, impact resilience and feeling when struck.

BACKGROUND OF THE INVENTION

Thread wound golf balls have a high impact resilience and a high initial velocity at the time of an impact, and exhibit good feeling when struck. They, however, are poor in durability.

In order to improve durability, one piece golf balls and two piece golf balls (i.e. solid golf balls) have been developed. The solid golf balls, however, are poor in impact resilience and feeling when struck, in comparison with the thread wound golf balls.

In order to improve the defects of the solid golf balls, Japanese Kokoku Publication (examined) 21426/1986 proposes that the hardness distribution of a golf ball, when measured by a JIS-C hardness meter, is controlled to 72 to 78 on the surface, 77 to 83 at 5 mm from the surface, 72 to 80 at a point 5 mm further inside, 67 to 75 at a point 5 further mm inside and less than 75 at the center. The proposed golf ball has improved impact resilience and durability, but is not sufficiently improved with respect to feeling when struck.

Japanese Kokai Publication (unexamined) 199471/1985 discloses that the hardness distribution of a golf ball core; when measured by a JIS-C hardness meter, is adjusted to 75 to 85 and a hardness difference between any two points of less than 5. This invention makes the hardness distribution flat to improve impact resilience, durability and feeling when struck. Thus, the feeling when struck becomes soft, but still requires improvement. If it is struck outside a sweet spot, one feels it to be heavy.

Japanese Kokai Publication (unexamined) 49840/1976 discloses a golf ball which comprises a core and a cover wherein the core is made of a plurality of layers, and the farther out the layer, the harder the hardness. However, it is complicated to produce the golf ball, thus making it expensive. The golf ball also is insufficient in durability.

SUMMARY OF THE INVENTION

The present invention provides a solid golf ball (including a one piece solid golf ball and another type of solid golf ball) which has excellent durability and a high impact resilience, as well as good feeling when struck. The solid golf ball of the present invention is characterized in that the hardness (H) of a rubber portion of the solid golf ball, when measured by a JIS-C hardness meter, discreases with distance from the surface to the center and meets the following equation;

When $0 \leqq l \leqq 5$ $415-6l \leqq 5$ $H \leqq 440-6l$

When $5 < l \leqq r$ $77 \leqq H \leqq 82$ wherein l is a distance (mm) from the surface and r is the radius of the golf ball.

DETAILED DESCRIPTION OF THE INVENTION

The hardness of the present invention is determined by cutting a golf ball in half and measuring on the center line of the half with a JIS-C hardness meter according to JIS vulcanized rubber physical test K-6301. The surface hardness is measured on the surface of the spherical rubber portion.

The hardness is simply reduced from the surface to the center. This does not mean the complete reduction of the hardness, but allows small scattering. Accordingly, it may happen that the minimum hardness is not on the center.

The hardness (H) and the distance (l) from the surface must meet the claimed equation. This equation is plotted on a graph with the hardness on the ordinate and the distance on the abscissa, thus showing a diagonal portion in FIG. 1. If the hardness of the surface is more than 89, impact resilience and crack resistance are poor. If the hardness between the center and a 5 mm inside from the surface is more than 82, the striking feeling becomes poor and one feels a hard feeling. If the hardness of the surface is less than 83, one feels the ball heavy at impact and impact resilience is also poor. If the hardness of the center is less than 77, impact resilience and crack resistance are lowered.

The term "rubber portion" herein means a ball itself in the case of a one piece solid golf ball as shown in FIG. 2, and a rubber core in the case of a two piece solid golf ball comprising a core and a cover covering the core as shown in FIG. 3. For the sake of simplicity a two piece golf ball is exemplified hereinafter.

The core of the golf ball is generally prepared by heating and molding a rubber composition which comprises base rubber, a metal salt of an unsaturated aliphatic acid, filler (e.g. zinc oxide) and polymerization initiator. Typical examples of the base rubbers are polybutadiene which is preferred, styrene-butadiene rubber, natural rubber, high-styrene resin and a mixture thereof. More preferred is cis 1,4-polybutadiene rubber. The unsaturated aliphatic metal salt includes a metal salt of a $C_3$–$C_8$ unsaturated aliphatic acid, such as zinc acrylate, zinc methacrylate, magnesium acrylate, magnesium methacrylate and the like, but preferred are zinc acrylate and zinc methacrylate. Typical examples of the polymerization initiators are peroxides, such as dicumylperoxide and the like. The polymerization initiator may be present in the rubber composition in an amount of 0.5 to 4 parts by weight based on 100 parts by weight of the base rubber. Amounts outside the range of the initiator do not provide suitable hardness range. The rubber composition may further contain filler, such as zinc white, barium sulfate, calcium carbonate, silica and the like. The rubber composition is generally prepared by mixing the above mentioned components, using a Bunbury mixer or a roll. It is pressure-molded or injection-molded into molds and then heated at a suitable temperature to form the core for the two piece solid golf ball.

A process for controlling the hardness within the claimed range is known to the art and can be effected by varying rubber composition, heating conditions and the like. For example, a rubber composition is heated under pressure to give an exothermic peak by the internal exothermic phenomenon, but the exothermic peak is controlled by adjusting a heating temperature to occur after 20 minutes from heat starting. At that temperature, the rubber composition is heated under pressure so as to adjust a hardness more than 77 near the center. Subsequently, the heating temperature is elevated to such a temperature that the hardness between the surface and a 5 mm inside from the surface may be adjusted to more than 83 and the hardness at other portion is made uniform, at which heating is then continued to prepare the golf ball of the present invention.

The cover covering the core is generally an ionomer resin, such as HI-MILAN (available from Dupont-Mitsui Polychemicals Co., Ltd.). The ionomer resin may contain inorganic fillers, such as titanium dioxide, zinc oxide and the like.

A process for covering the core with the ionomer resin is also known to the art, and not limited. For example, the core is covered with two half shells of the ionomer resin and then molded under pressure. Also, the ionomer resin may be injection-molded to cover the core.

The present invention provides a solid golf ball which has excellent durability and a high impact resilience, as well as a good striking feeling.

EXAMPLES

Figure 1:
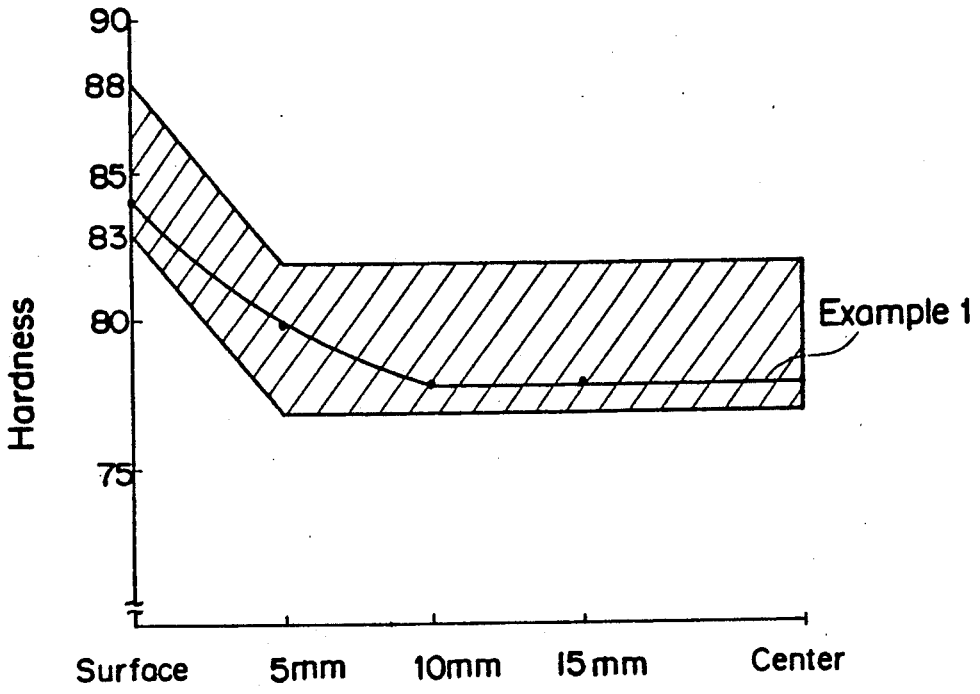
FIG. 1 is a graph in which the claimed relation is plotted with the hardness on ordinates and the distance on abscissas. The solid line in FIG. 1 shows the plot of Example 1.
Figure 2:
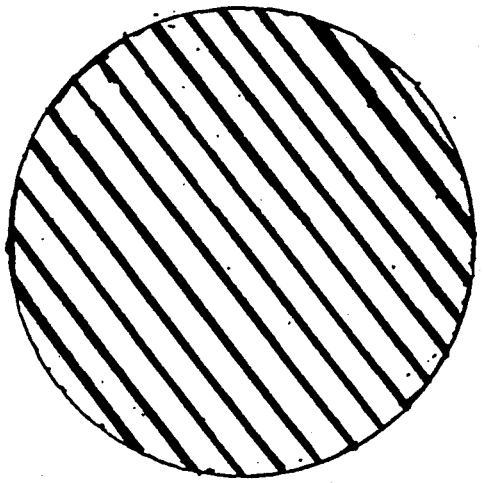
FIG. 2 shows a one piece solid golf ball.
Figure 3:
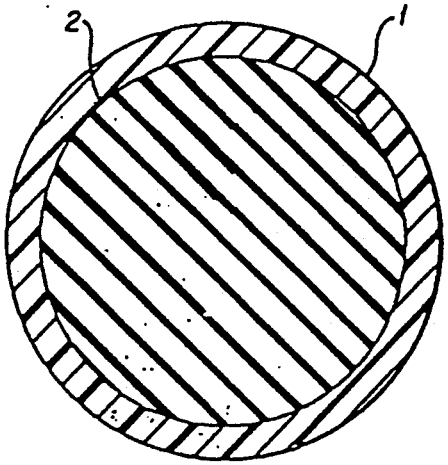
FIG. 3 shows a two piece solid golf ball comprising a core 2 and a cover 1 covering the core.

The present invention is illustrated by the following examples which, however, are not construed as limiting the invention to their details.

EXAMPLE 1 AND COMPARATIVE EXAMPLES 1 TO 5

The following ingredients were mixed and then vulcanized in a mold at conditions shown in Table 1 according to a press molding process to form a solid core having a diameter of 38.2 mm.

| Ingredients | Parts by weight |
|---|---|
| Butadiene rubber (available from Japan Synthetic Rubber Co., Ltd. as BR-01) | 100 |
| Zinc acrylate | 35 |
| Zinc oxide | 18 |
| Dicumylperoxide | 1.2 |
| Yoshinox 425 (2,2'-methylene-bis-(4-ethyl-6-t-butylphenol) | 0.5 |

The obtained core was covered with a cover resin composition which contains 100 parts by weight of HI-MILAN 1702 and 2 parts by weight of titanium oxide to obtain a large size two piece solid golf ball. The physical properties of the golf ball were evaluated and the results are shown in Table 1.

TABLE 1

| | | Example No. | Comparative Example No. | | | | |
|---|---|---|---|---|---|---|---|
| | | 1 | 1 | 2 | 3 | 4 | 5 |
| Vulcanizing conditions | | 145° C., 35 min. then 175° C., 15 min. | 167° C., 24 min. | 160° C., 27 min. | 148° C. 35 min. | 145° C., 35 min. then 185° C., 20 min. | 145° C., 35 min. then 160° C., 10 min. |
| Hardness distribution | Surface | 84 | 82 | 79 | 67 | 89 | 77 |
| | 5 mm inside | 80 | 80 | 80 | 76 | 85 | 77 |
| | 10 mm inside | 78 | 72 | 78 | 78 | 82 | 77 |
| | 15 mm inside | 78 | 67 | 72 | 78 | 80 | 77 |
| | Center | 78 | 62 | 65 | 77 | 80 | 76 |
| Hardness difference | | 6 | 20 | 15 | 11 | 9 | 1 |
| Exothermic peak occurrence time (min) | | 25 | 13 | 17 | 22 | 25 | 25 |
| Ball compression | | 102 | 98 | 99 | 95 | 105 | 100 |
| Crack resistance | | 100 | 80 | 90 | 90 | 96 | 96 |
| Initial velocity (45 m/sec) | | 65.5 | 64.5 | 64.6 | 64.5 | 65.2 | 65.1 |

Compresion: According to the PGA rule.

Crack resistance: A golf ball repeatedly collides with a panel at 45 m/sec, and the number of collisions at which the ball cracks is expressed with an index in which the number of Example 1 is regarded as 100.

Initial velocity: An initial velocity of a golf ball which is struck at a head speed of 45 m/sec.

Five golfers strike the golf ball and evaluate feeling when struck. The results are shown in Table 2.

TABLE 2

| Golfer | Head speed | Example No. 1 | Comparative Example No. 1 | 2 | 3 | 4 | 5 |
|---|---|---|---|---|---|---|---|
| Pro A | 50 m/sec | Light and good response | Too light | Light | Hard core, slightly heavy fly insufficiently | Hard but fly more | Soft and good, but slightly heavy |
| Pro B | 50 m/sec | Soft and fly well | Light and fly insufficiently | Light and soft | Good response but heavy | Slightly hard but good | Soft and good |
| Lesson Pro C | 43 m/sec | Soft and good response | Too light | Good and soft | Heavy and feel crushed | Hard and strong response | Soft and good |
| Amateur D | 49 m/sec | Light but fly more | Feel crushed and no response | Soft | Hardcore | Too strong response | Feel slightly crushed but good |
| Amateur E | 45 m/sec | Soft | Too light | Light and good | Good response | Heavy response but good | Good |
| Total evaluation | | Very good | Bad | Good | Bad | Bad | Ordinary |

The golf ball of Example 1 is excellent in crack resistance and impact resilience (initial velocity).

Comparative Example 1 provides a golf ball which has a lower hardness than the claimed hardness range near center and is poor in crack resistance and initial velocity.

Comparative Example 2 provides a golf ball which also has a lower hardness than the claimed hardness range at a center. The golf ball is good in striking feeling, but poor in crack resistance and initial velocity.

Comparative Example 3 provides a golf ball which has a lower hardness than the claimed hardness range on a surface. The golf ball is good in initial velocity, but poor in striking feeling and crack resistance.

Comparative Example 4 provides a golf ball which has a higher hardness than the claimed hardness range at a surface. The golf ball is good in initial velocity, but very poor in striking feeling.

Comparative Example 5 provides a golf ball which has substantially uniform hardness throughout the core which is outside the claimed hardness range. The golf ball is quite good properties, but less than that of the present invention.

EXAMPLE 2 AND COMPARATIVE EXAMPLES 6 TO 10

The following ingredients were mixed and then vulcanized in a mold at conditions shown in Table 3 according to a press molding process to form a solid core having a diameter of 38.2 mm.

| Ingredients | Parts by weight |
|---|---|
| Butadiene rubber (available from Japan Synthetic Rubber Co., Ltd. as BR-01) | 100 |
| Zinc acrylate | 36 |
| Zinc oxide | 18 |
| Dicumylperoxide | 1.2 |
| Yoshinox 425 (2,2'-methylene-bis-(4-ethyl-6-t-butylphenol) | 0.5 |

The obtained core was covered with a cover resin composition which contains 100 parts by weight of Hi-Miran 1707 and 2 parts by weight of titanium oxide to obtain a large size two piece solid golf ball. The physical properties of the golf ball were evaluated and the results are shown in Table 3.

TABLE 3

| | | Example No. | Comparative Example No. | | | | |
|---|---|---|---|---|---|---|---|
| | | 2 | 6 | 7 | 8 | 9 | 10 |
| Vulcanizing conditions | | 146° C., 35 min. then 175° C., 20 min. | 167° C., 24 min. | 160° C., 27 min. | 148° C. 35 min. | 146° C., 35 min. then 185° C., 25 min. | 146° C., 35 min. then 165° C., 15 min. |
| Hardness distribution | Surface | 84 | 82 | 80 | 66 | 90 | 79 |
| | 5 mm inside | 82 | 79 | 79 | 76 | 86 | 80 |
| | 10 mm inside | 81 | 74 | 78 | 79 | 83 | 79 |
| | 15 mm inside | 79 | 72 | 73 | 80 | 81 | 80 |
| | Center | 80 | 68 | 70 | 79 | 82 | 81 |
| Hardness difference | | 5 | 14 | 10 | 14 | 9 | 2 |
| Exothermic peak occurrence time (min) | | 26 | 14 | 19 | 25 | 26 | 26 |
| Ball compression | | 106 | 101 | 102 | 98 | 108 | 104 |
| Crack resistnace | | 100 | 85 | 92 | 90 | 98 | 98 |
| Initial velocity (45 m/sec) | | 65.7 | 64.7 | 64.9 | 64.8 | 65.3 | 65.4 |

Four golfers strike the golf ball and evaluate feeling when struck. The results are shown in Table 4.

TABLE 4

| Golfer | Head speed | Example No. 2 | Comparative Example No. 6 | 7 | 8 | 9 | 10 |
|---|---|---|---|---|---|---|---|
| Pro A | 50 m/sec | Good rebound | Soft and slightly good | Slightly heavy | Heavy and hard core | Hard | Slightly hard and good response |
| Lesson Pro B | 46 m/sec | Light and good rebound | Light but poor fly | Good response | Heavy and poor rebound | Hard and poor rebound | Good respone but slightly heavy |
| Lesson Pro C | 43 m/sec | Slightly hard but good | Light and good | Slightly hard | Heavy | Effect on hands | Hard but good response |
| Amateur D | 45 m/sec | Light | Soft | Soft | Hard | Hard | Soft |
| Total evaluation | | Good | Good | Ordinary | Bad | Bad | Ordinary |

Example 2 provides a golf ball which has harder near center than that of Example 1. The ball is excellent in crack resistance and impact resilience (initial velocity), as well as striking feeling.

Comparative Example 6 provides a golf ball which has higher hardness difference and is good in striking feeling, but poor in crack resistance and initial velocity.

Comparative Example 7 provides a golf ball which has lower hardness difference than Comparative Example 6, but outside the claimed range. The golf ball is poor in all properties.

The golf ball of Comparative Example 8 is fairly good in crack resistance, but poor in striking feeling and initial velocity.

Comparative Example 9 provides a golf ball which has a higher hardness than that of the present invention at a surface. The golf ball is good in initial velocity and crack resistance, but very poor in striking feeling.

Comparative Example 10 provides a golf ball which has uniform hardness throughout a core, but higher hardness than that of Comparative Example 5. The golf ball is fairly good properties, but less than that of the present invention.

What is claimed is:

1. A solid golf ball comprising rubber, wherein a hardness (H) of the rubber portion of the solid golf ball, when measured by a JIS-C hardness meter, decreases with distance from the surface to the center and satisfies the following relationships:

when $0 \leqq l \leqq 5$, then $415-6\,l \leqq 5\ H \leqq 440-6\,l$; and when $5 < l \leqq r$, then $77 \leqq H \leqq 82$, wherein l represents the distance in mm from the surface and r represents the radius of the golf ball.

2. The solid golf ball according to claim 1 wherein said golf ball is a one piece solid golf ball.

3. The solid golf ball according to claim 1 wherein said golf ball is a two piece solid golf ball which comprises a core and a cover covering said core.

4. The solid golf ball according to claim 1 wherein said rubber portion is a heated and molded rubber composition which comprises a base rubber, a metal salt of an unsaturated aliphatic acid, zinc oxide and a polymerization initiator.

5. The solid golf ball according to claim 4 wherein said base rubber is cis 1,4-polybutadiene rubber.

6. The solid golf ball according to claim 4 wherein said metal salt of unsaturated aliphatic acid is zinc acrylate or zinc methacrylate.

7. The solid golf ball according to claim 4 wherein said polymerization initiator is dicumylperoxide.

8. The solid golf ball according to claim 4 wherein said rubber composition has hardened properties resulting from being heated under pressure to give an exothermic peak after 20 minutes from initial heating and then the heating temperature is elevated to such a temperature that the hardness between the surface and a portion 5 mm inside from the surface is adjusted to from 83 to 88 and the hardness at other portions made uniform.

9. The solid golf ball according to claim 4 wherein the polymerization initiator is present in the rubber composition in an amount of 0.5 to 4 parts by weight based on 100 parts by weight of the base rubber.

10. The solid golf ball according to claim 4 wherein said base rubber is cis 1,4-polybutadiene rubber, said metal salt of an unsaturated aliphatic acid is zinc acrylate or zinc methacrylate and said polymerization initiator is dicumylperoxide.

* * * * *